US006015108A

United States Patent [19]

Okumura et al.

[11] Patent Number: 6,015,108

[45] Date of Patent: Jan. 18, 2000

[54] CRUSHER

[75] Inventors: Takashi Okumura; Hiroshi Okada; Yoshifumi Itoh, all of Nabari, Japan

[73] Assignee: Nippon Pneumatic Manufacturing Co., Ltd., Osaka, Japan

[21] Appl. No.: 09/078,664

[22] Filed: May 14, 1998

[30] Foreign Application Priority Data

Dec. 3, 1996 [JP] Japan ..... 8-322966

[51] Int. Cl.[7] ..... B02C 1/10

[52] U.S. Cl. ..... 241/101.73; 241/266

[58] Field of Search ..... 241/101.73, 264, 241/266

[56] References Cited

U.S. PATENT DOCUMENTS

| | | | |
|---|---|---|---|
| 3,750,532 | 8/1973 | Kubilos | 91/3 |
| 4,354,555 | 10/1982 | Lang | 172/4 |
| 4,812,122 | 3/1989 | Mueller | 434/18 |
| 5,628,611 | 5/1997 | Ito et al. | 414/737 |
| 5,660,337 | 8/1997 | Falbo et al. | 241/37 |

FOREIGN PATENT DOCUMENTS

| | | |
|---|---|---|
| 195 24 226 | 1/1996 | Germany . |
| 197 10 949 | 10/1997 | Germany . |
| 2236965 | 4/1991 | United Kingdom . |

*Primary Examiner*—Joseph J. Hail, III
*Assistant Examiner*—Dermott J. Cooke
*Attorney, Agent, or Firm*—Wenderoth, Lind & Ponack, L.L.P.

[57] ABSTRACT

A crusher which is simple in structure and capable of dismantling a building structure and recovering iron material from among dismantled remains of a building. A movable jaw is provided so as to be opened and closed relative to a fixed jaw fixed to the crusher main frame. A magnetic case made of a nonmagnetizable material is provided on the bottom of the main frame. A permanent magnet assembly is slidably mounted in the case. The permanent magnet assembly is connected to a hydraulic cylinder for sliding the permanent magnet. By actuating the hydraulic cylinder, the permanent magnet will move down so that iron material is attracted through a bottom plate of the magnet case. By raising the permanent magnet assembly, the magnet weakens, so that the attracted iron material drops by gravity.

11 Claims, 3 Drawing Sheets

CRUSHER

BACKGROUND OF THE INVENTION

This invention relates to a crusher used to dismantle buildings and other structures.

A crusher is mounted on an arm tip of a civil engineering machine such as a backhoe to dismantle buildings.

The crusher has a fixed jaw secured to the crusher main frame, and a movable jaw provided pivotally opposite the fixed jaw. The movable jaw is opened and closed by a hydraulic cylinder to dismantle a building and break dismantled material into smaller pieces in cooperation with the fixed jaw.

Cutting blades provided on the fixed and movable jaws cut iron material, such as iron bars, exposed from the building being dismantled.

Iron material thus cut is recovered from the dismantled wastes. Manually recovering such iron material is extremely troublesome and also dangerous because the dismantled remains of a building may collapse.

In order to solve this problem, crushers disclosed in unexamined Japanese patent publications 8-13815 and 4-155068 have a permanent magnet mounted in the main body having the fixed jaw to recover iron material from among dismantled remains by magnetically attracting such iron material with the permanent magnet.

In the case of the crusher disclosed in unexamined Japanese patent publication 8-13815, a permanent magnet is slid in a composite frame comprising a nonmagnetic frame and a magnetic frame. With the permanent magnet in the nonmagnetic frame, iron material is attracted, and the attraction force is released by sliding the permanent magnet into the magnetic frame. To slide the permanent magnet, a force greater than the attraction force applied to the magnetic frame has to be applied to the permanent magnet. Thus, a large load is applied to a link mechanism for converting the opening/closing movement of the movable jaw into sliding motion of the permanent magnet. The link mechanism thus tends to become shaky soon and its life is short.

In this arrangement, the composite frame is provided in a relatively small space in the crusher body. Only the bottom of the nonmagnetic frame of the composite frame is used as the surface for attracting iron material. Thus, the attracting surface area is thus small, so that it is impossible to recover iron material with high efficiency.

In the case of the crusher disclosed in unexamined Japanese patent publication 4-155068, a permanent magnet is slidably mounted in a nonmagnetic casing so as to define front and rear chambers in the casing. Pressure oil is alternately supplied into one of the chambers to move the permanent magnet. Thus, the permanent magnet, which corresponds to a piston of a hydraulic cylinder, tends to be influenced by water contained in pressure oil.

Further, it is necessary to seal the front and rear chambers from each other by mounting a seal member on the outer periphery of the permanent magnet. Since the permanent magnet with the seal member is slid along the inner surface of the casing, the inner surface of the casing has to be finished with an extremely high degree of accuracy. Thus, machining is extremely troublesome and costly.

An object of this invention is to provide a crusher with a permanent magnet which is simple in structure and inexpensive.

SUMMARY OF THE INVENTION

According to the present invention, there is provided a crusher comprising a frame having a pair of side plates, a fixed jaw fixed to the frame, a movable jaw pivotally supported on the frame at a position opposite the fixed jaw, a first hydraulic cylinder for opening and closing the movable jaw relative to the fixed jaw, a magnet case mounted between the pair of side plates of the frame, a permanent magnet assembly slidably mounted in the magnet case, and a second hydraulic cylinder connected to the permanent magnet assembly for sliding the permanent magnet assembly. The first and second hydraulic cylinders are operatively associated with each other.

According to the present invention, on-off valves are provided in an oil feed line communicating with the front chamber of the second hydraulic cylinder and in an oil feed line communicating with the rear chamber of the second hydraulic cylinder. By actuating the on-off valves, pressurized oil can be sealed in the front or rear chamber of the hydraulic cylinder. Thus the permanent magnet can be moved only when collecting the iron bars and can be held in an inoperative position when breaking the dismantled material and cutting the iron bars.

Also, according to the present invention, a throttle is provided between one of the on-off valves and the front chamber of the second hydraulic cylinder, and a check valve is provided in a bypass line having one end thereof communicating with the inlet end of the throttle and the other end with the outlet end of the throttle. This prevents oil in the front chamber of the second hydraulic cylinder from flowing through the bypass line. This assures that the permanent magnet moves quickly away from the bottom plate of the magnet case and moves slowly toward the bottom plate.

Other features and objects of the present invention will become apparent from the following description made with reference to the accompanying drawings, in which:

DETAILED DESCRIPTION OF THE PREFERRED EMBODIMENT

Now an embodiment of this invention is described with reference to the attached drawings.

Figure 1:
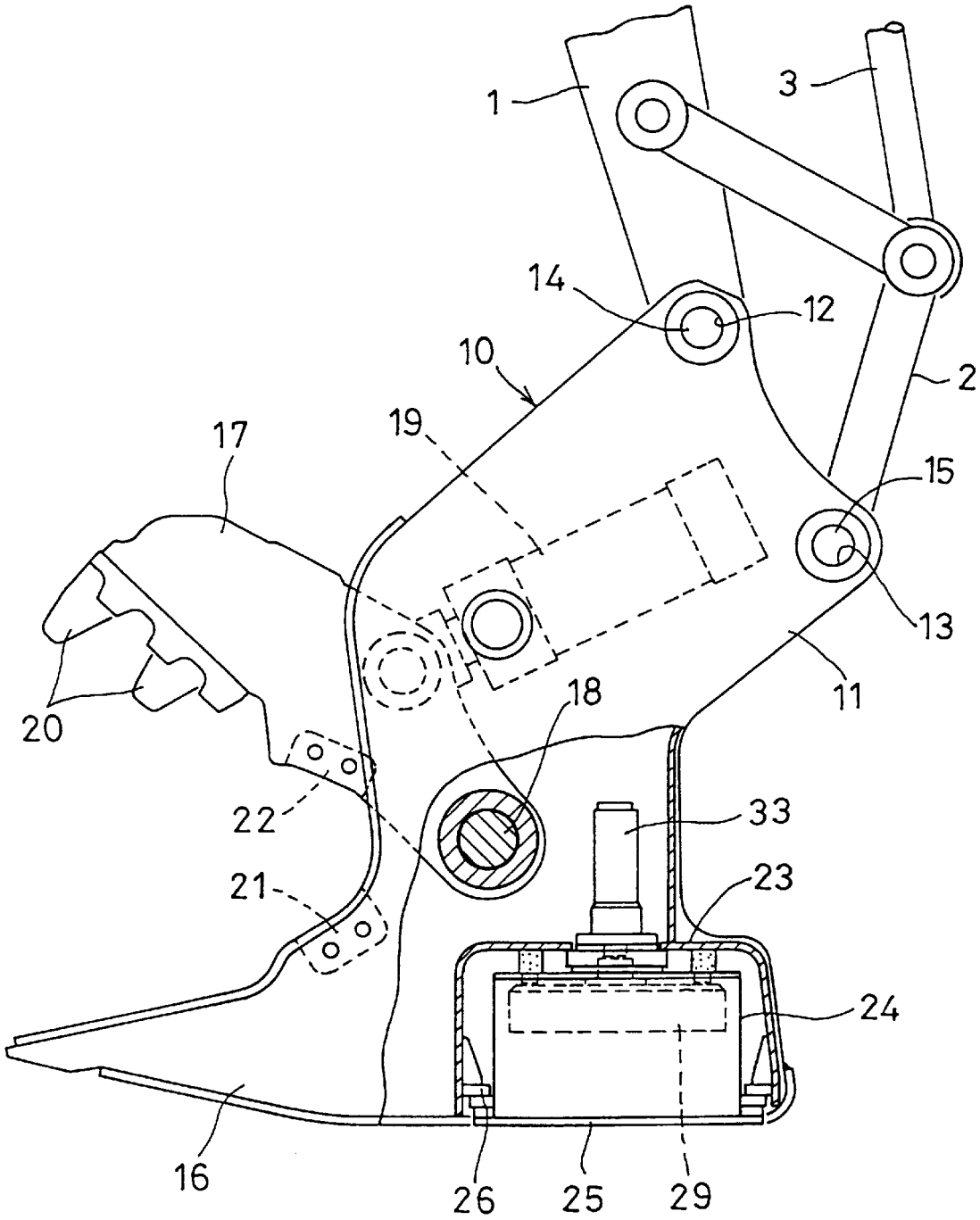
FIG. 1 is a partially cutaway front view of a crusher embodying the present invention.

As shown in FIG. 1, a main frame 10 has a pair of side plates 11 each formed with a pair of pin holes 12, 13 at the upper portion thereof.

The frame 10 is pivotally mounted on the tip of an arm 1 of a civil engineering machine by a pin 14 inserted through the holes 12. A two-joint link 2 has one end thereof coupled to the tip of the arm 1 and the other end to the frame 10 by a pin 15 inserted through the holes 13.

A cylinder 3 is coupled to the connecting portion of the joints of the link 2. By activating the cylinder 3, the frame 10 is pivoted about the pin 14.

A fixed jaw 16 is provided at one side of the lower portion of the frame 10. Opposite the jaw 16, a movable jaw 17 is pivotally supported on a shaft 18 extending between the pair of side plates 11.

The movable jaw 17 is opened and closed relative to the fixed jaw 16 by a hydraulic cylinder 19 provided between the pair of side plates 11.

The movable jaw 17 has crushing teeth 20 at its tip. The fixed jaw 16 and the movable jaw 17 carry cutting blades 21, 22, respectively, opposite each other to cut iron members.

An open-bottomed housing 23 is provided at the bottom of the frame 10. A hollow magnet case 24 is mounted in the housing 23.

Figure 2B:
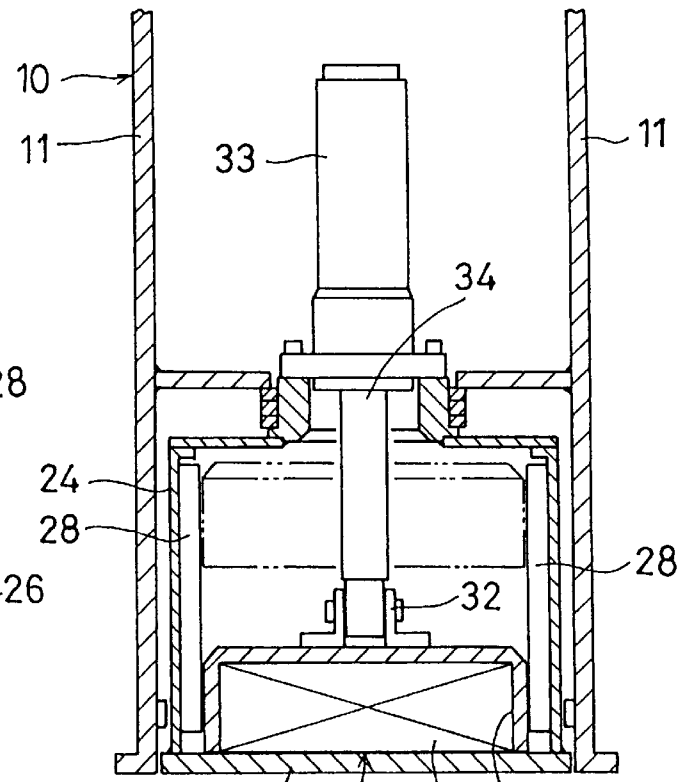
FIG. 2B is a section taken along line II—II of FIG. 2A.
Figure 2A:
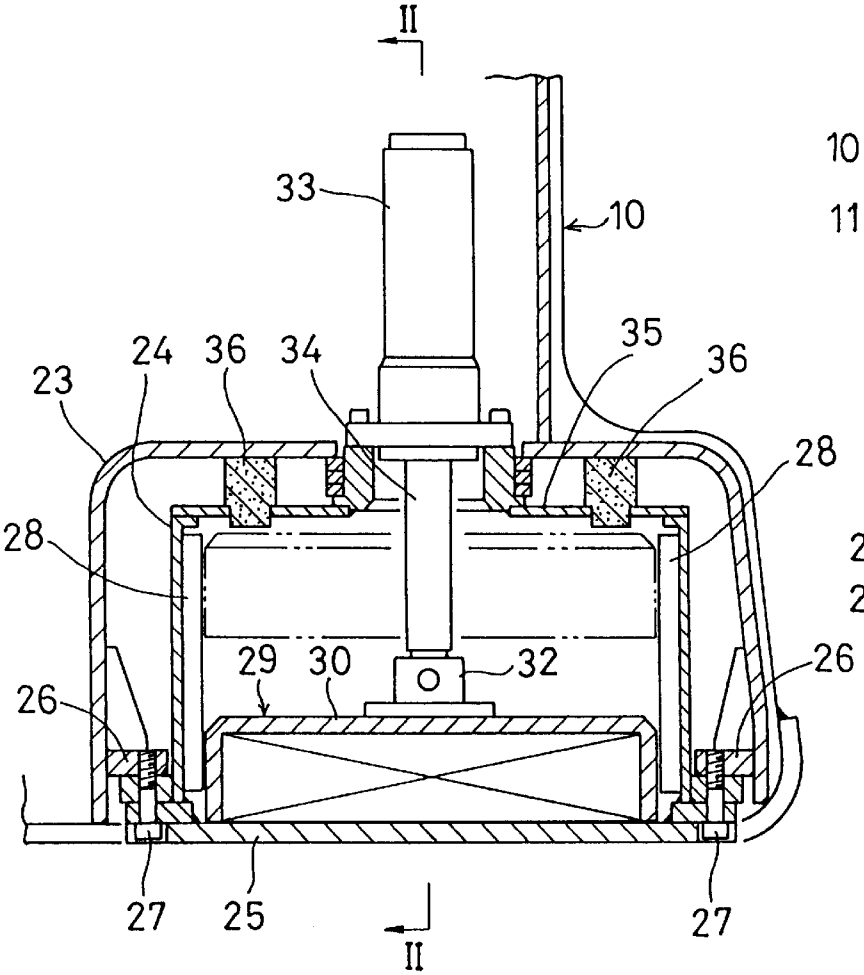
FIG. 2A is an enlarged sectional view of an iron attracting portion of the crusher of FIG. 1.

The magnet case 24 is made from a nonmagnetizable material, and as shown in FIG. 2A, has a bottom plate 25 fixed by tightening bolts 27 against supports 26 fixed to the inner surface of the housing 23 near its bottom.

In the case 24, a permanent magnet assembly 29 is vertically slidably supported between vertical guides 28. The permanent magnet assembly 29 comprises an open-bottomed, box-shaped yoke 30 made from a magnetizable material, and a permanent magnet 31 mounted in the yoke 30. The yoke 30 has at its top a coupling piece 32 coupled to a piston rod 34 of a hydraulic cylinder 33 for sliding the magnet 31. The cylinder 33 is bolted to a top plate 35 of the magnet case 24. Cushioning members 36 are provided on the top plate 35 to absorb shocks when the permanent magnet assembly 29 collides against the top plate 35.

Figure 3:
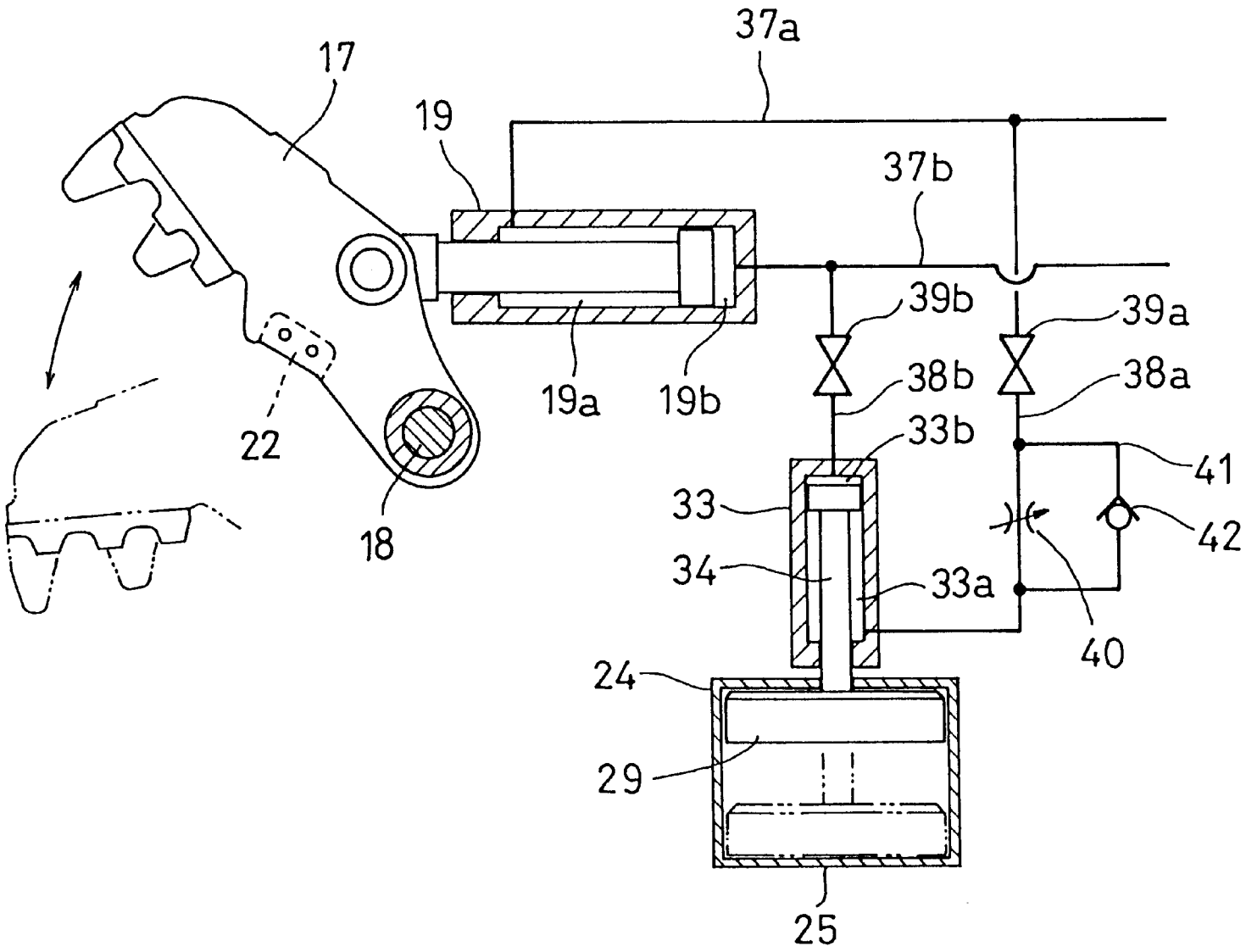
FIG. 3 shows a hydraulic circuit of the crusher of FIG. 1.

FIG. 3 shows a hydraulic circuit. Oil feed lines 37*a* and 37*b* are connected to a cylinder front chamber 19*a* and a cylinder rear chamber 19*b* of the hydraulic cylinder 19 to open and close the movable jaw 17, respectively.

From a hydraulic pressure generating unit (not shown) mounted on the civil engineering machine, pressure oil is supplied to the oil feed lines 37*a*, 37*b* through a changeover valve. Lines 38*a* and 38*b* branch from the lines 37*a* and 37*b*, respectively. The line 38*a* is connected to a front chamber 33*a* of the cylinder 33, while the other line 38*b* is connected to its rear chamber 33*b*.

Thus, when pressure oil is supplied into the line 37*a* to open the movable jaw 17, pressure oil in the line partially flows into the front chamber 33*a* of the cylinder 33, thus raising the permanent magnet assembly 29. When the movable jaw 17 is closed, the permanent magnet assembly 29 is lowered.

On-off valves 39*a* and 39*b* are provided in the lines 38*a* and 38*b*, respectively, to selectively supply pressure oil to the hydraulic cylinder 33. The line 38*a* communicating with the front chamber 33*a* has a throttle 40 disposed between the on-off valve 39*a* and the front chamber 33*a*. The hydraulic circuit further includes a bypass line 41 having one and the other ends thereof communicating with the inlet and outlet ends of the throttle 40, respectively. A check valve 42 is provided in the bypass line 41 to prevent oil in the front chamber 33*a* from flowing through the bypass line 41 toward the on-off valve 39*a*.

In operation, the movable jaw 17 is opened and closed about the shaft 18 by supplying pressure oil to the hydraulic cylinder 19 to dismantle a building with the movable jaw 17 and the fixed jaw 16, and to break dismantled material into smaller pieces and to cut e.g. iron bars.

If, during dismantling operations, the on-off valves 39*a*, 39*b* are open, pressure oil is supplied into the hydraulic cylinder 33. The permanent magnet assembly 29 will thus be unnecessarily moved up and down as the movable jaw 17 is opened and closed. In order to prevent this problem, the on-off valves 39*a*, 39*b* are closed to keep the permanent magnet assembly 29 at the elevated position under the pressure of oil sealed in the front chamber 33*a*.

To recover iron material such as iron bars from among dismantled wastes, the on-off valves 39*a*, 39*b* shown in FIG. 3 are opened to lower the permanent magnet assembly 29 by supplying pressure oil to the rear chamber 33*b* of the hydraulic cylinder 33. Iron material is thus attracted to the bottom surface of the bottom plate 25 of the magnet case 24 by a magnetic flux flowing through the bottom plate 25.

When the permanent magnet assembly 29 is lowered, the throttle 40 restricts the flow of oil from the front cylinder chamber 33*a* through the line 38*a*. The assembly 29 is thus lowered slowly, making it possible for the assembly 29 to soft-land on the bottom plate 25.

Iron material attracted to the bottom 25 of the magnet case 24 is moved to a predetermined position e.g. by turning the arm, and pressure oil is supplied to the front chamber 33*a* of the hydraulic cylinder 33 to raise the permanent magnet assembly 29. This weakens the magnetic force, so that the iron material drops by gravity.

As the permanent magnet assembly 29 is raised, pressure oil flowing through the branch line 38*a* flows into the front cylinder chamber 33*a* from both the throttle 40 and the check valve 42. This permits the permanent magnet assembly 29 to quickly rise, so that iron material attracted thereto is instantly released and dropped.

In the embodiment, the hydraulic cylinder 19 for opening and closing the movable jaw 17 is operatively associated with the hydraulic cylinder 33 so that when the movable jaw 17 is opened, the permanent magnet assembly 29 is raised simultaneously. But instead, the oil line may be arranged such that the on-off valve 39*a* communicates with the rear cylinder chamber 33*b* and the on-off valve 39*b* communicates with the front cylinder chamber 33*a* to raise the permanent magnet assembly 29 when the movable jaw 17 is closed.

As described above, the lines 38*a*, 38*b* branching from the lines 37*a*, 37*b* leading to the cylinder for opening and closing the movable jaw are connected to the hydraulic cylinder 33, so that the opening and closing of the movable jaw 17 can be operatively associated with the sliding movement of the permanent magnet assembly 29. The structure is thus simple, and the hydraulic circuit can be constructed easily. The changeover between ordinary operations of dismantling and breakage of material into smaller pieces and iron recovery operations is done easily by opening and closing the on-off valves 39*a*, 39*b* provided in the lines 38*a*, 38*b*.

The mounting position of the magnet case 24 is not limited to the bottom of the frame 10. It may be mounted on the other side, i.e. the side on which the fixed jaw 16 is not formed.

As described above, according to this invention, the structure is simple. No accurate machining of the magnet case and the permanent magnet assembly is required. The entire crusher can thus be manufactured at a low cost. Since the permanent magnet assembly is slid toward and away from the iron attracting surface, it is possible to provide a larger iron attracting surface as compared with an arrangement in which the permanent magnet is slid parallel to the iron attracting surface.

By closing the on-off valves, the permanent magnet assembly is stopped and held at a slide position, so that during crushing of a building, in which the crushing jaws are opened and closed, it is possible to prevent unnecessary movement of the permanent magnet.

The permanent magnet assembly can be moved quickly away from the bottom plate of the magnet case, so that the attraction of iron material can be released instantly. Also, the permanent magnet assembly can be slowly moved toward the bottom plate, so that it is possible to prevent breakage of the bottom plate by colliding with the permanent magnet assembly.

What is claimed is:

1. A crusher comprising a frame having a pair of side plates, a fixed jaw fixed to said frame, a movable jaw pivotally supported on said frame at a position opposite said fixed jaw, a first hydraulic cylinder for opening and closing said movable jaw relative to said fixed jaw, a magnet case mounted between said pair of side plates of said frame, a permanent magnet assembly slidably mounted in said magnet case, and a second hydraulic cylinder connected to said permanent magnet assembly for sliding said permanent magnet assembly in said magnet case, wherein said first and second hydraulic cylinders are operatively associated with each other, wherein said permanent magnet assembly comprises:

an open-bottomed box-shaped yoke formed of a magnetizable material;

a permanent magnet mounted in said yoke; and a coupling member provided on an upper outer surface of said yoke, said coupling member being coupled to a piston rod of said second hydraulic cylinder.

2. A crusher as claimed in claim 1, further comprising a first on-off valve provided in an oil feed line communicating with a front chamber of said second hydraulic cylinder and a second on-off valve provided in an oil feed line communicating with a rear chamber of said second hydraulic cylinder.

3. A crusher as claimed in claim 2, further comprising a throttle means provided between said second on-off valve and said front chamber of said second hydraulic cylinder, a bypass line having one end thereof communicating with the inlet end of said throttle means and the other end with the outlet end of said throttle means, and a check valve provided in said bypass line for preventing oil in said front chamber of said second hydraulic cylinder from flowing through said bypass line.

4. A crusher as claimed in claim 1, further comprising:

an open-bottomed housing mounted at a lower portion of said frame and surrounding said magnet case; and a plurality of cushioning members disposed between a top wall of said magnet case and an internal peripheral surface of said open-bottomed housing.

5. A crusher as claimed in claim 4, wherein said magnet case is formed of a non-magnetizable material.

6. A crusher as claimed in claim 1, wherein said magnet case includes a plurality of vertical guides for guiding movement of said permanent magnet assembly in said magnet case.

7. A crusher comprising:

a frame having a pair of side plates;

a fixed jaw fixed to said frame;

a movable jaw pivotally supported on said frame at a position opposite said fixed jaw;

a first hydraulic cylinder for opening and closing said movable jaw relative to said fixed jaw;

a magnet case mounted between said pair of side plates of said frame;

a permanent magnet assembly comprising an open-bottomed yoke formed of a magnetizable material and a permanent magnet mounted in said yoke, wherein said permanent magnet assembly is slidably mounted in said magnet case; and a second hydraulic cylinder connected to said permanent magnet assembly for sliding said permanent magnet assembly in said magnet case;

a first hydraulic line communicating between a front chamber of said second hydraulic cylinder and a front chamber of said first hydraulic cylinder;

a first on-off valve provided in said first hydraulic line;

a second hydraulic line communicating between a rear chamber of said second hydraulic cylinder and a rear chamber of said first hydraulic cylinder; and a second on-off valve provided in said second hydraulic line.

8. A crusher as claimed in claim 7, further comprising:

an open-bottomed housing mounted at a lower portion of said frame and surrounding said magnet case; and a plurality of cushioning members disposed between a top wall of said magnet case and an internal peripheral surface of said open-bottomed housing.

9. A crusher as claimed in claim 8, wherein said magnet case is formed of a non-magnetizable material.

10. A crusher as claimed in claim 7, further comprising:

a throttle disposed in said first hydraulic line between said first on-off valve and said front chamber of said second hydraulic cylinder;

a bypass line connected to said first hydraulic line and bypassing said throttle; and a check valve provided in said bypass line for preventing hydraulic fluid from flowing through said bypass line in a direction toward said first on-off valve.

11. A crusher as claimed in claim 7, wherein said magnet case includes a plurality of vertical guides for guiding movement of said permanent magnet assembly in said magnet case.

* * * * *